US005153400A

United States Patent [19]

Merten

[11] Patent Number: 5,153,400

[45] Date of Patent: Oct. 6, 1992

[54] MULTIPLE SWITCH

[75] Inventor: Günter Merten, Mellieha, Malta

[73] Assignee: Merit-Elektrik GmbH, Gummersbach, Fed. Rep. of Germany

[21] Appl. No.: 532,967

[22] Filed: Jun. 4, 1990

[30] Foreign Application Priority Data

Jul. 20, 1989 [DE] Fed. Rep. of Germany ..... 3924109

[51] Int. Cl.[5] ..... H01H 1/16; H01H 1/06; H01H 1/50

[52] U.S. Cl. ..... 200/277; 200/11 R; 200/11 J; 200/11 K

[58] Field of Search ..... 200/11 R, 11 J, 11 K, 200/277

[56] References Cited

U.S. PATENT DOCUMENTS 5,017,744 5/1991 Yoshida ..... 200/277

FOREIGN PATENT DOCUMENTS 3441161 10/1986 Fed. Rep. of Germany .

*Primary Examiner*—A. D. Pellinen
*Assistant Examiner*—D. Le
*Attorney, Agent, or Firm*—Michael J. Striker

[57] ABSTRACT

A multiple switch, particularly for switching-on, switching-off and/or switching-over of motor vehicles and the like has at least one roller-shaped contact roller with a generated contact surface liftable from and bringable in contact with at least two rectilinear contact faces located near one another. The contact roller is arranged in a springy deflectable manner in a guiding part displaceable rectilinearly transversely to an axis of the contact roller and parallel to the contact surfaces. The contact roller is provided with bearing pins extending at its end sides outwardly beyond the roller surface, and is linearly displaceable by the bearing pins running over at least one control path with the ramp device so that during a displacement of the guiding part the roller is lifted at its one side from one of the contact faces.

10 Claims, 2 Drawing Sheets

MULTIPLE SWITCH

BACKGROUND OF THE INVENTION

The present invention relates to a multiple switch, particularly for switching-on, switching-off, and/or switching-over for a motor vehicle or similar applications. More particularly, it relates to such a switch which is a roller-shaped contact roller which is under a spring pressure and has a roller contact surface which is liftable from neighboring contact surfaces by means of control paths and ramp devices and bringable in contact with the contact surfaces.

Such multiple switches which are used especially as switches for switching-on, switching-off and/or switching-over in power vehicles and the like must provide for a sufficient service life with high operational safety despite the fact that they are subjected to high stresses and loads under the action of high number of switchings on the one hand and atmospheric influences such as air moisture, dirtying and the like, on the other hand. This sufficient service life with high operational safety can be achieved only with a minimal possible contact wear or burning. Also, noise generation during the switching process is often disturbing.

SUMMARY OF THE INVENTION

Accordingly, it is an object of the present invention to provide a multiple switch of the above mentioned general type which avoids the disadvantages of the prior art.

More particularly, it is an object of the present invention to provide a multiple switch which with high loads and a minimum noise generation during individual switching steps has a long service life, and satisfies requirements of a minimum possible contact wear.

In keeping with these objects and with others which will become apparent hereinafter, one feature of the present invention resides, briefly stated, in a multiple switch in which contact surfaces are formed rectilinear, the contact surface of the contact roller is bringable in contact with two contact surfaces arranged near one another, the contact roller is arranged in a springy deflectable manner on a guiding part which is rectilinearly displaceable transversely to the axis of the contact roller and parallel to the contact surfaces and has two bearing pin extending outwardly beyond the roller surface at the end faces, the contact roller by means of the bearing pins is linearly guided on at least one control path extending near the contact surfaces with the ramp device so that during a displacement of the guiding part the roller is lifted at one side from one contact surface.

The multiple switch in accordance with the present invention has the advantage that the electrically conductive connection between the current supply and the current output is provided by a rolling connecting part, namely a contact roller, in cooperation with one or more ramp devices. In the switched-off position of the switch, the contact roller is separated at least at one end from the contact face by a ramp. If the current circuit is to be closed, the mechanical actuating part or guiding part of the switch moves the contact roller preferably over an inclined surface of the ramp onto the contact face and provides for an electrical connection. When the use of high-grade and therefore expensive contact material is required or desirable, this contact material can be limited to one of several contact points in correspondence with the current flow.

It is especially advantageous for the number of switchings and thereby for the service life of such a switch that the contact establishment and the contact interruption are always performed in a predetermined point of the rolling connecting part. In correspondence with the current flow, possibly required high-grade contact material is needed only on one contact surface. It is especially advantageous that due to different diameters of the generated contact surface of the contact roller and the outwardly extending bearing pins in connection with the respective ramp, at each of the two control paths the ramp acts not at the same point on the contact roller to lift or to lower the same, at which the electrically conductive connection is produced.

The rolling connecting part or the contact roller can be composed of one part or several parts.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
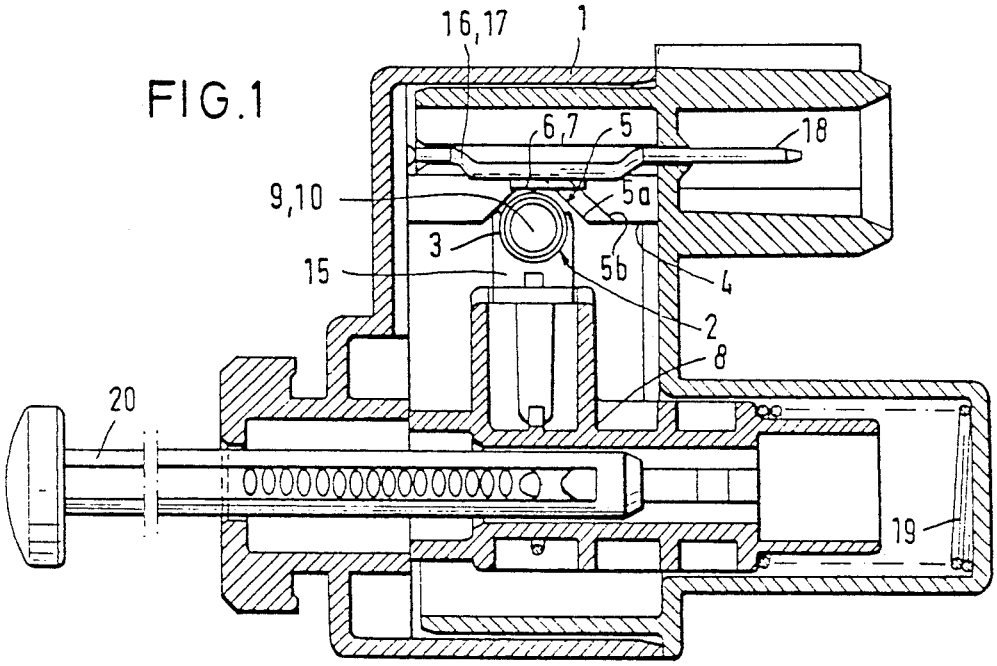
FIG. 1 is a view showing a longitudinal section of a switch in accordance with the present invention with a contact roller and an actuating plunger in the first switching position.
Figure 2:
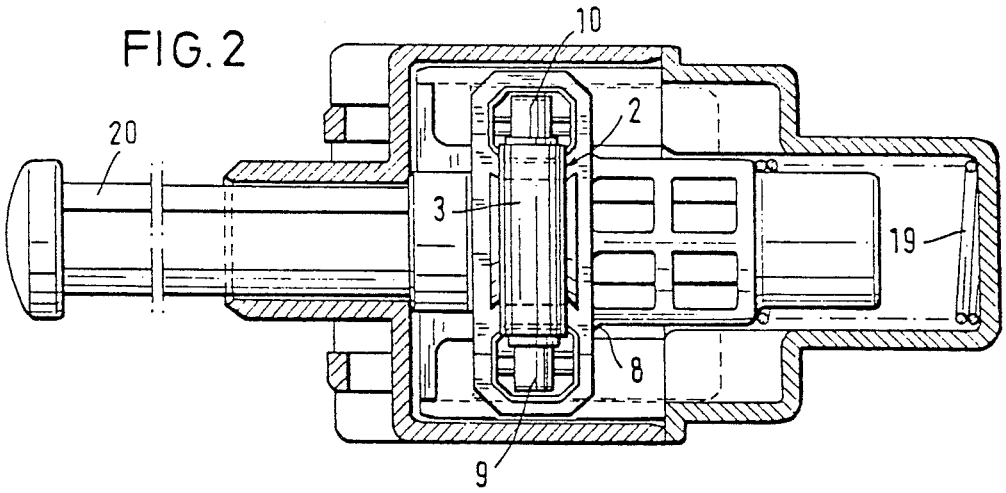
FIG. 2 is a view showing a horizontal section of the switch of the present invention in the swichting position of FIG. 1.

A multiple switch in accordance with the present invention can be used for switching-on, switching-off and/or switching-over for power vehicles and similar applications. As shown in FIGS. 1 and 2, it has a housing 1 which accommodates at least one roller-shaped contact roller 2. The contact roller 2 is arranged under spring pressure and has a cylindrical generated contact surface 3 which is liftable from neighboring contact surfaces 6, 7 and bringable into contact therewith by means of control paths 4 and ramp devices 5. The contact surfaces 6 and 7 of the switch are rectilinear. The generated contact surface 3 of the contact roller 2 extends over at least two neighboring contact faces 6, 7.

The contact roller 2 is arranged in a springy deflectable manner on a guiding part 8. The guiding part 8 is rectilinearly displaceable transverse to the axis of the contact roller 2 and parallel to the contact faces 6 and 7 in the housing. The contact roller 2 has bearing pins 9 and 10 each extending at the ends beyond the generated contact surface 3 and having a smaller diameter than the generated contact surface 3.

The contact roller 2 is linearly displaceably guided by its bearing pins 9, 10 over at least one control path 4 located near the contact faces 6, 7, by means of an inclined ramp device 5. The guidance is such that the contact roller 2 during a displacement of the guiding part 8 is lifted from one of the contact faces 6, 7 at one end.

As can be seen further from the drawings, the control paths 4 arranged at both sides of the two contact faces 6, 7 are provided each with ramps 5*a*, 5*b* for the bearing pins 9, 10 of the contact roller 2. The ramps 5*a*, 5*b* are offset relative to one another in the displacement direction of the guiding part 8.

Figure 3:
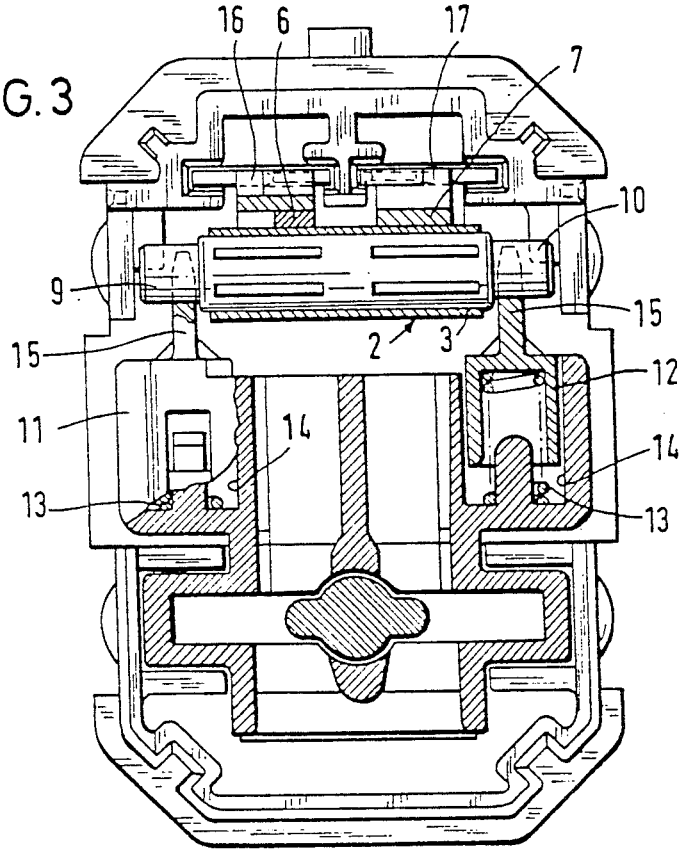
FIG. 3 is a view showing a partial section through the switch in the switching position of FIG. 1.

In a first initial position of FIGS. 1-3, the contact roller 2 lies with its generated contact surface 3 on both contact faces 6, 7 simultaneously. In a second intermediate position after rectilinear displacement of the guiding part 8 in the longitudinal direction of the contact faces, 6, 7, it is inclinedly lifted first by one ramp 5*a* from the associated contact surface 6. After a further rectilinear displacement of the guiding part 8 it is also lifted from the second contact surface 7 by running of the opposite bearing pin 10 on the ramp 5*b* of the second control path 4, which ramp is linearly displaced relative to the first ramp 5*a*.

As can be seen further from FIGS. 1-3, the contact roller with its bearing pins 9, 10 is supported on the guiding part 8 by two bearing pieces 11, 12. The bearing pieces 11, 12 are displaceable independently from one another transversely to the displacement direction of the guiding part 8 and against the action of helical springs 13. The bearing pieces 11, 12 are displaceably guided up and down in a non-rotatable manner on the guiding part 8 in multi-corner or oval, preferably shaped octagonal guiding bushes 14. Each of the bearing pieces 11, 12 have a fork-shaped bearing web 15 for the bearing pin 9, 10 of the contact roller 2.

The bearing web 15 engages the bearing pins 9, 10 at both sides between the generated contact surface 3 of the contact outwardly extending control paths 4 and ramp devices 5 in a U-shaped manner. Thereby an especially quiet and accurate guidance of the bearing pin 9 of the contact roller 2 transverse to the control paths 4, the ramp devices 5 and also relative to the contact faces 6, 7 is achieved. Also, a simple mounting during assembly of the switch is provided.

Figure 4:
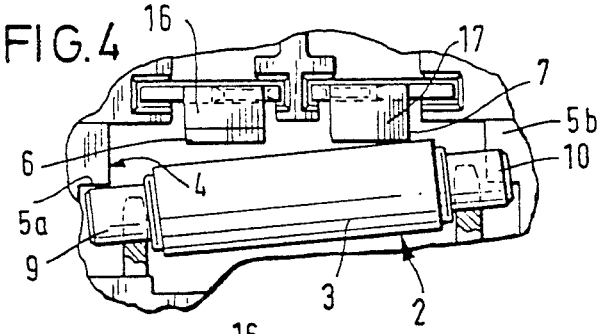
FIG. 4 is a partial view of the contact roller in an inclined position lifted from one of two contact surfaces.
Figure 5:
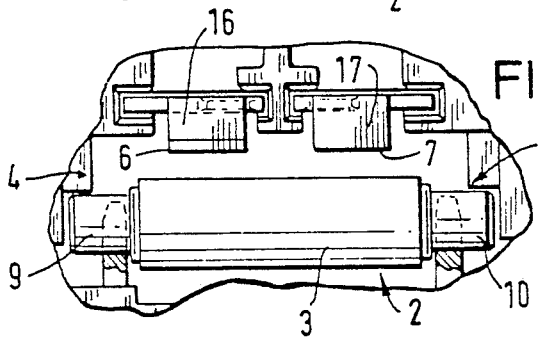
FIG. 5 is a partial view showing the contact roller in an off position in which it is lifted from two contact surfaces in a parallel location.

The contact faces 6, 7 of the switch are provided with plug tongues 18 on strip-shaped contact parts 16, 17 which extend parallel to the displacement direction of the guiding part 8 for the contact roller 2 as shown in FIGS. 3-5. The guiding part 8 is longitudinally displaceable in the switch housing against the pressure of a helicle spring 19. It also has an actuating pin 20 which projects from the switch housing 1 and is the actuating pins 20 are arranged arrestably on the guiding part 8 in various longitudinal positions.

Figure 6:
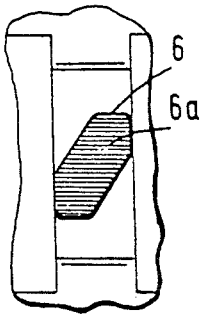
FIG. 6 is a partial plan view of a contact surface of the switch provided with a coating in accordance with the present invention.

Finally, as can be seen from FIG. 6, a contact face 6 has a ribbed coating 6*a*. It can be applied for example by a silver plating and arranged diagonally to the actuating direction of the switch or the displacement direction of the contact roller 2. This way a possibly occurring contact burning on this flat surface can also shift the contact engagement with the contact roller 2 and therefore improved contact properties can be obtained.

It will be understood that each of the elements described above, or two or more together, may also find a useful applicaiton in other types of constructions differing from the types described above.

While the inveniton has been illustrated and described as embodied in a multiple switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A multiple switch, particularly a switching-on, switching-off and/or switching-over switch for motor vehicles and the like, comprising at least one roller-shaped contact roller having a generated contact surface; means forming rectilinear contact faces; control paths with ramp devices arranged to lift said contact surface from and to bring it in contact with at least two such contact faces located near one another; a guiding part displaceable rectilinearly transversely to an axis of said contact roller and parallel to said contact faces, said contact roller being arranged in said guiding part in a springy deflectable manner and being provided with bearing pins extending at its end faces outwardly beyond said contact surface, said contact roller being linearly displaceable by means of said bearing pins over at least one said control path extending next to said contact faces with said ramp device; pressure springs; two bearing pieces which are displaceable independently from one another transverse to the displacement direction of said guiding part against the action of said pressure springs and arranged so that said contact roller is supported by said bearing pins on said guiding part through said bearing pieces, said bearing pieces having a fork-shaped bearing web for said bearing pins of said contact roller, said bearing webs of said bearing pieces engaging said bearing pins at both sides between said contact surface of said contact roller and outside said control path and ramp device in a U-shaped manner, said contact roller during a displacement of said guiding part and a ramming of one of said bearing pins on said ramp device is lifted at its one end from one of said contact faces.

2. A multiple switch as defined in claim 1; and furhter comprising a switch housing, said guiding part being rectilinearly displaceable in said switch housing.

3. A multiple switch as defined in claim 2, wherein said guiding part has an actuating pin which extends from said switch housing and is arranged arrestably on said guiding part in various longitudinal positions.

4. A multiple switch as defined in claim 1; and further comprising strip-shaped contact parts extending parallel to the displacement direction of said guiding part for said contact roller, said contact faces being formed on said contact parts.

5. A multiple switch as defined in claim 1, wherein at least one of said contact faces has a ribbed coating extending diagonally to an actuation direction of the switch and provided for a contact engagement with said contact roller.

6. A multiple switch as defined in claim 1, wherein said guiding part has shaped guiding bushes, said bearing pieces being reciprocatably displaceable in said guiding bushes of said guiding part.

7. A multiple switch as defined in claim 6, wherein said bearing pieces have in a cross-section a shape which deviates from a circular shape.

8. A multiple switch as defined in claim 7, wherein said bearing pieces having a mutli-cornered shape.

9. A multiple switch as defined in claim 7, wherein said bearing pieces having an oval shape.

10. A multiple switch as defined in claim 1, wherein said control paths include two control paths located at both sides of said contact faces and said ramp devices include contact ramps offset in a displacement direction, said contact roller being guided on said two control paths with said ramps so that in a first position it simultaneously lies on both said contact faces, in a second position after a rectilinear displacement of said guiding part in a longitudinal direction of said contact faces it is inclinedly lifted by a first one of said ramps from one of said contact faces, and after a further rectilinear displacement of said guiding part it is completely lifted by means of a second one of said ramps from both said contact faces.

* * * * *